US009746134B2

(12) United States Patent
Dailly et al.

(10) Patent No.: US 9,746,134 B2
(45) Date of Patent: Aug. 29, 2017

(54) METHOD OF STORING AND USING NATURAL GAS IN A VEHICLE

(71) Applicant: GM Global Technology Operations LLC, Detroit, MI (US)

(72) Inventors: Anne M. Dailly, West Bloomfield, MI (US); Arianna T. Morales, Royal Oak, MI (US); Mahmoud H. Abd Elhamid, Troy, MI (US); Mei Cai, Bloomfield Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 699 days.

(21) Appl. No.: 14/222,950

(22) Filed: Mar. 24, 2014

(65) Prior Publication Data

US 2014/0290751 A1 Oct. 2, 2014

Related U.S. Application Data

(60) Provisional application No. 61/806,141, filed on Mar. 28, 2013.

(51) Int. Cl.

| | |
|---|---|
| ***F02B 43/00*** | (2006.01) |
| ***F17C 13/08*** | (2006.01) |
| ***F17C 11/00*** | (2006.01) |

(52) U.S. Cl.

CPC ..... *F17C 13/084* (2013.01); *F17C 11/007* (2013.01); *Y10T 29/49826* (2015.01); *Y10T 137/0318* (2015.04)

(58) Field of Classification Search

CPC ..... F17C 13/084; F17C 11/007; Y10T 137/0318; Y10T 29/49826

See application file for complete search history.

(56) References Cited

U.S. PATENT DOCUMENTS

| | | | | |
|---|---|---|---|---|
| 4,523,548 A * | 6/1985 | Engel | F02B 43/00 123/1 A |
| 4,749,384 A * | 6/1988 | Nowobilski | F17C 5/007 123/527 |
| 8,302,802 B2 | 11/2012 | Handa | |

(Continued)

FOREIGN PATENT DOCUMENTS

| | | |
|---|---|---|
| CN | 1347488 | 5/2002 |
| EP | 0633422 | 1/1995 |

(Continued)

*Primary Examiner* — Hung Q Nguyen

(74) *Attorney, Agent, or Firm* — Harness, Dickey & Pierce, P.L.C.

(57) ABSTRACT

A method of storing and using natural gas (NG) in a vehicle includes selecting a vehicle having an NG tank for fueling an engine of the vehicle. The tank service pressure rating is 3600 psi (pounds per square inch) and an NG adsorbent is in the tank. A first quantity of NG is transferred into the tank from a first source having a first source pressure less than 725 psi. The adsorbent adsorbs a portion of the NG. After transferring the first quantity of NG, the engine is operated until NG is desorbed and consumed by the engine. NG is transferred into the tank from a second source to fill the tank to a second tank pressure of about 3600 psi. The adsorbent adsorbs some of the NG. After transferring the second quantity of the NG, the engine is operated until NG is desorbed and consumed by the engine.

11 Claims, 1 Drawing Sheet

(56) References Cited

U.S. PATENT DOCUMENTS

| | | | | |
|---|---|---|---|---|
| 2002/0023539 | A1* | 2/2002 | Tange | C10L 3/06 95/143 |
| 2002/0117123 | A1* | 8/2002 | Hussain | B82Y 30/00 123/3 |
| 2014/0026868 | A1* | 1/2014 | Dolan | F02D 19/0647 123/525 |

FOREIGN PATENT DOCUMENTS

| | | |
|---|---|---|
| EP | 1759760 | 3/2007 |
| WO | WO2011/159259 | 12/2011 |

* cited by examiner

METHOD OF STORING AND USING NATURAL GAS IN A VEHICLE

CROSS REFERENCE TO RELATED APPLICATIONS

This application claims the benefit of U.S. Provisional Patent Application Ser. No. 61/806,141 filed Mar. 28, 2013, which is incorporated by reference herein in its entirety.

BACKGROUND

Natural gas fueled vehicles have tanks onboard for storing natural gas. The onboard natural gas storage tanks are typically refuelable at either high pressure (commercial/fleet) fuel stations or low pressure fuel stations that may, for example, be located at a residence. Typically, the onboard natural gas storage tanks on a vehicle are optimized for filling at either the low pressure stations or the high pressure stations. Standard nozzles for high pressure fuel stations are not compatible with the refueling receptacles on vehicles with designated low pressure natural gas systems to avoid exceeding the service pressure of the low pressure natural gas systems.

SUMMARY

A method of storing and using natural gas in a vehicle includes selecting a vehicle having a tank for storing natural gas for fueling an engine of the vehicle. The tank has a service pressure rating of about 3600 psi (pounds per square inch). A natural gas adsorbent is positioned in tank. The method further includes transferring a first quantity of natural gas into the tank from a first source having a first source pressure of less than about 725 psi causing a first tank pressure to be up to 725 psi. The adsorbent adsorbs an adsorbed portion of the natural gas in the tank. After transferring the first quantity of natural gas without transferring additional natural gas into the tank, the engine is operated until at least a portion of the natural gas has been desorbed from the adsorbent and consumed by the engine. A second quantity of the natural gas is transferred into the tank from a second source having a second source pressure of at least about 3600 psi to fill the tank to a second tank pressure of about 3600 psi. The adsorbent adsorbs an adsorbed quantity of the natural gas. After transferring the second quantity of the natural gas without transferring additional natural gas into the tank, the engine is operated until at least a portion of the natural gas has been desorbed from the adsorbent and consumed by the engine.

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Figure 1:
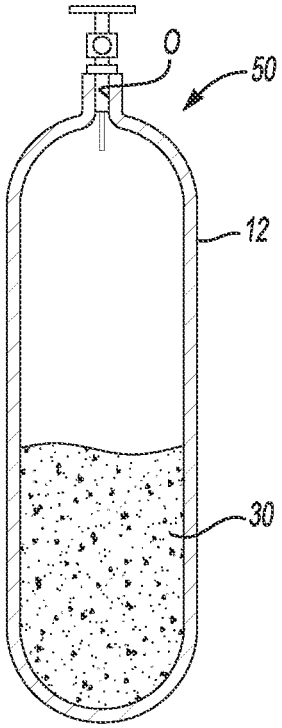
FIG. 1 is a cross-sectional, semi-schematic view of an example of a tank according to the present disclosure.

Natural gas vehicles are fitted with on-board storage tanks Some natural gas storage tanks are designated as low pressure tanks Low pressure natural gas tanks are normally rated for pressures up to about 750 psi. For example, the low pressure tank for a low pressure system may be rated for pressures of about 725 psi and lower. In other examples, the low pressure tank for the low pressure system may be rated for pressures up to a range of between about 300 psi and 1000 psi. During fueling, the container of the low pressure system storage tank is designed to fill until the tank achieves a pressure within the designated range. Designated low pressure system storage tanks are generally not rated for pressures above the designated range. In contrast, other natural gas storage tanks are designated high pressure tanks High pressure natural gas tanks are normally rated for pressures ranging from about 3,000 psi (207 bar or 20.7 MPa (megapascals)) to about 3,600 psi (248 bar or 24.8 MPa). Similar to the low pressure tanks, the container of the high pressure natural gas storage tank is designed to fill until the tank achieves a pressure within the rated range. When the high pressure tanks are partially filled, i.e. filled to a pressure lower than the designated range, the amount of natural gas extractable from the tank may be insufficient to operate the vehicle for desired driving distance (i.e., to obtain a desirable mileage).

In the examples disclosed herein, incorporating a particular natural gas adsorbent into a container that is rated for the higher pressures results in a versatile natural gas tank that is suitable for use as both a low pressure system and a high pressure system. In particular, the container of the versatile tank is rated for the higher pressures, and the adsorbent in the versatile tank increases the storage capacity so that the tank is capable of storing and delivering a sufficient amount of natural gas for desired vehicle operation when filled to the lower pressures.

As an example, at about 725 psi (50 bar), a vehicle including a 0.1 $m^3$ (i.e., 100 L) versatile natural gas tank according to the present disclosure filled with a suitable amount of a carbon adsorbent having a Brunauer-Emmett-Teller (BET) surface area of about 1000 $m^2/g$, a bulk density of 0.5 $g/cm^3$, and a total adsorption of 0.13 g/g is expected to have 2.85 GGE (gasoline gallon equivalent). For comparison, a 100 L tank would have about 1.56 GGE at the same pressure. Assuming a vehicle may have an expected fuel economy of 30 miles per gallon, 2.85 GGE will allow the vehicle to be operated over a distance range of about 85 miles. Furthermore, the tank in the example may advantageously be refilled either using low pressure stations (e.g., home refueling stations) or using high pressure fueling stations (e.g., retail or fleet refueling stations). In examples of the present disclosure, the adsorbent boosts the distance range achievable, which may be advantageous in times or locations when high pressure refueling stations may not be available or convenient.

It is believed that the adsorption effect of the quantity of adsorbent in the examples disclosed herein is high enough to compensate for any loss in storage capacity due to the skeleton of the adsorbent occupying volume in the container. For the same temperature and pressure, the density of the gas in the adsorbed phase is greater than the density of the gas in the gas phase. As such, the adsorbent will improve the container's storage capacity of natural gas at relatively low pressures (compared, for example, to the same type of container that does not include the adsorbent), while also maintaining or improving the container's storage capacity at higher pressures. It would be desirable to store the same amount of natural gas in a tank having adsorbent as described herein at about 725 psi that can be stored in the same size (volume) compressed natural gas tank at about 3,600 psi without the adsorbent. The examples disclosed herein work to achieve this goal.

Increased storage capacity may lead to improved vehicle range between refueling. It is believed that the examples disclosed herein will have equal or greater natural gas storage capacity for a given volume compared to existing compressed gas technology.

Referring now to FIG. 1, an example of the natural gas tank 50 is depicted. The tank 50 generally includes a container body 12 and a natural gas adsorbent 30 positioned within the container body 12.

The container body 12 may be made of any material that is suitable for a reusable pressure vessel with a service pressure rating of about 3,600 psi. Examples of suitable container body 12 materials include high strength aluminum alloys and high strength low-alloy (HSLA) steel. Examples of high strength aluminum alloys include those in the 7000 series, which have relatively high yield strength as discussed above. One specific example includes aluminum 7075-T6 which has a tensile yield strength of 73,000 psi. Examples of high strength low-alloy steel generally have a carbon content ranging from about 0.05% to about 0.25%, and the remainder of the chemical composition varies in order to obtain the desired mechanical properties.

While the shape of the container body 12 shown in FIG. 1 is a cylindrical canister, it is to be understood that the shape and size of the container body 12 may vary depending, at least in part, on an available packaging envelope for the tank 50 in the vehicle. For example, the size and shape of the container body 12 may be changed in order to fit into a particular portion of a vehicle trunk space. In an example, the container may have an inner diameter ranging from about 10.2 cm (centimeters) to about 40.6 cm. As disclosed herein, the container body 12 may be a container body 12 from a tank 50, as described above.

In the example shown in FIG. 1, the container body 12 is a single unit having a single opening O or entrance. The opening O may be covered with a plug valve. While not shown, it is to be understood that the container body 12 may be configured with other container bodies 12 so that the plurality of container bodies 12 is in fluid (e.g., gas) communication through a manifold or other suitable mechanism.

As illustrated in FIG. 1, the natural gas adsorbent 30 is positioned within the container body 12. Suitable adsorbents 30 are at least capable of releasably retaining methane compounds (i.e., reversibly storing or adsorbing methane molecules). In some examples of the present disclosure, the adsorbent 30 may also be capable of reversibly storing other components found in natural gas, such as other hydrocarbons (e.g., ethane, propane, hexane, etc.), hydrogen gas, carbon monoxide, carbon dioxide, nitrogen gas, hydrogen sulfide, and/or water. In still other examples, the adsorbent 30 may be inert to some of the natural gas components and capable of releasably retaining other of the natural gas components.

In general, the adsorbent 30 has a high surface area and is porous. The size of the pores is generally greater than the effective molecular diameter of at least the methane compounds. In an example, the pore size distribution is such that there are pores having an effective molecular diameter of the smallest compounds to be adsorbed and pores having an effective molecular diameter of the largest compounds to be adsorbed. In an example, the adsorbent 30 has a BET surface area ranging from about 50 square meters per gram ($m^2/g$) to about 5,000 $m^2/g$, and includes a plurality of pores having a pore size ranging from about 0.20 nm (nanometers) to about 50 nm.

Examples of suitable adsorbents 30 include carbon (e.g., activated carbons, super-activated carbon, carbon nanotubes, carbon nanofibers, carbon molecular sieves, zeolite templated carbons, etc.), zeolites, metal-organic framework (MOF) materials, porous polymer networks (e.g., PAF-1 or PPN-4), and combinations thereof. Examples of suitable zeolites include zeolite X, zeolite Y, zeolite LSX, MCM-41 zeolites, silicoaluminophosphates (SAPOs), and combinations thereof. Examples of suitable metal-organic frameworks include HKUST-1, MOF-74, ZIF-8, and/or the like, which are constructed by linking structural building units (inorganic clusters) with organic linkers (e.g., carboxylate linkers).

The volume that the adsorbent 30 occupies in the container body 12 will depend upon the density of the adsorbent 30. In an example, the density of the adsorbent 30 may range from about 0.1 g/cc (grams per cubic centimeter) to about 0.9 g/cc. A well packed adsorbent 30 may have a density of about 0.5 g/cc. In an example, a 100 L container may include an amount of adsorbent that occupies about 50 L. For example, an amount of adsorbent that occupies about 50 L means that the adsorbent would fill a 50 L container. It is to be understood, however, that there is space available between the particles of adsorbent, and having an adsorbent that occupies 50 L in a 100 L container does not reduce the capacity of the container for natural gas by 50 L.

Figure 2:
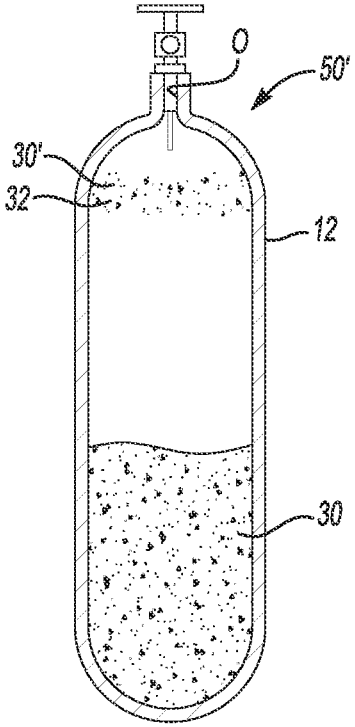
FIG. 2 is a cross-sectional, semi-schematic view of an example of a tank including a guard bed according to the present disclosure.

Referring now to FIG. 2, another example of the natural gas tank 50' is depicted. The tank 50' generally includes the container body 12 and the natural gas adsorbent 30 positioned within the container body 12. In the example depicted in FIG. 2, the tank 50' also includes a guard bed 32 positioned at or near the opening O of the container body 12 so that introduced natural gas passes through the guard bed 32 before reaching the adsorbent 30. The guard bed 32 may filter out certain components (contaminants) so that only predetermined components (e.g., methane and other components that are reversibly adsorbed on the adsorbent 30) reach the adsorbent 30. It is contemplated that any adsorbent 30' that will retain the contaminants may be used as the guard bed 32. For example, the guard bed 32 may include an adsorbent 30' material that will remove higher hydrocarbons (i.e. hydrocarbons with more than 4 carbon atoms per molecule) and catalytic contaminants, such as sulfur-based compounds (e.g. hydrogen sulfide) and water. In an example, the guard bed 32 may include adsorbent 30' material that retains one or more of the certain components while allowing clean natural gas to pass therethrough. The adsorption of the certain components may assist in removing the contaminants at the point of the guard bed 32 and may reduce or entirely prevent exposure of the adsorbent 30 to the contaminants. The pore size of the adsorbent 30' in the guard bed 32 may be tuned/formulated for certain types of contaminants so that the guard bed 32 is a selective adsorbent. In an example, the guard bed 32' may be positioned outside of the container body near the opening of the container body. Such an external guard bed 32' may be easily removed for restoration or replacement.

In an example of the present disclosure, the adsorbent 30 may be regenerated, so that any adsorbed components are released and the adsorbent 30 is cleaned. In an example, the adsorbent 30 regeneration may be accomplished either thermally or with inert gases. For example, sulfur may be burned off when the adsorbent 30 is treated with air at 350° C. For another example, contaminants may be removed by flushing the adsorbent 30 with argon gas or helium gas. After a regeneration process, the original adsorption capacity of the adsorbent 30 may be substantially or completely recovered. As used herein, substantially recovered means 90 percent of the capacity is recovered.

Figure 3:
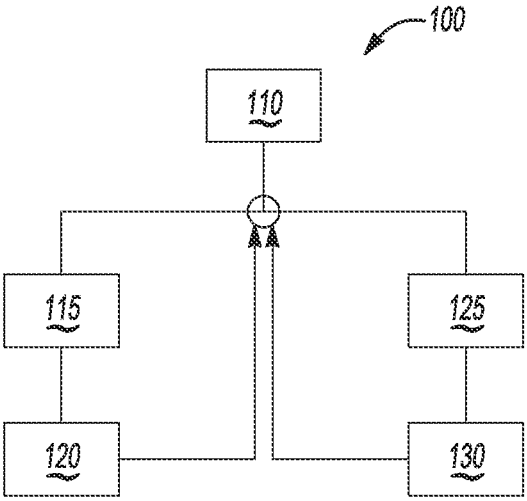
FIG. 3 is a flow chart depicting an example of a method of storing and using natural gas in a vehicle according to the present disclosure.

FIG. 3 is a flow chart depicting an example of a method of storing and using natural gas in a vehicle according to the present disclosure. The method 100 begins at 110, selecting a vehicle having a tank for storing natural gas for fueling an engine of the vehicle, the tank having a service pressure rating of about 3600 psi (pounds per square inch) and the tank having a natural gas adsorbent positioned in the tank. At 115, a step depicts transferring a first quantity of natural gas into the tank from a first source having a first source pressure of less than about 725 psi causing a first tank pressure to be up to 725 psi wherein the adsorbent adsorbs an adsorbed portion of the natural gas in the tank. Step 115 is followed by step 120: operating the engine after transferring the first quantity of natural gas without transferring additional natural gas into the tank until at least a portion of the natural gas has been desorbed from the adsorbent and consumed by the engine. Step 125 is transferring a second quantity of the natural gas into the tank from a second source having a second source pressure of at least about 3600 psi to fill the tank to a second tank pressure of about 3600 psi wherein the adsorbent adsorbs an adsorbed quantity of the natural gas. Step 125 is followed by step 130: operating the engine after transferring the second quantity of the natural gas without transferring additional natural gas into the tank until at least a portion of the natural gas has been desorbed from the adsorbent and consumed by the engine. After step 120, the flow chart returns to 135, which is an entry point back into the flow logic before steps 115 and 125. Steps 115 and 125 may be performed in any order, however it is to be understood that all branches of the method 100 must be performed at some time in order to be storing and using natural gas in a vehicle according to the example of the method 100.

In the method 100, the use of the terms "first source", "first quantity", "second source", and "second quantity" etc. is used to distinguish the first from the second, but not necessarily to convey temporal order. For example, the second source may be used before the first source, or the first source may be used before the second source. As such, the example of the natural gas storage tank 50 has a capability of being refueled at low pressure stations and high pressure stations in any temporal order.

For example, the natural gas storage tank 50 may be refueled at a low pressure station most days and the vehicle may have enough range for typical daily use. If the vehicle is required for an occasional longer trip, then the natural gas storage tank 50 may be refueled at a high pressure station to have an extended vehicle distance range. The adsorbent 30 extends the vehicle distance range when refueled at the low pressure station and at the high pressure station.

In an example of the method of making the natural gas storage tank 50, the container body 12 may be formed and then the adsorbent 30 may be introduced into the container body 12. In another example of the method, the adsorbent 30 may be introduced during the manufacturing of the container body 12.

It is to be understood that the ranges provided herein include the stated range and any value or sub-range within the stated range. For example, a range from about 0.1 g/cc to about 0.9 g/cc should be interpreted to include not only the explicitly recited limits of about 0.1 g/cc to about 0.9 g/cc, but also to include individual values, such as 0.25 g/cc, 0.49 g/cc, 0.8 g/cc, etc., and sub-ranges, such as from about 0.3 g/cc to about 0.7 g/cc; from about 0.4 g/cc to about 0.6 g/cc, etc.

Furthermore, when "about" is utilized to describe a value, this is meant to encompass minor variations (up to +/−10%) from the stated value.

In describing and claiming the examples disclosed herein, the singular forms "a", "an", and "the" include plural referents unless the context clearly dictates otherwise.

It is to be understood that the terms "connect/connected/connection" and/or the like are broadly defined herein to encompass a variety of divergent connected arrangements and assembly techniques. These arrangements and techniques include, but are not limited to (1) the direct communication between one component and another component with no intervening components therebetween; and (2) the communication of one component and another component with one or more components therebetween, provided that the one component being "connected to" the other component is somehow in operative communication with the other component (notwithstanding the presence of one or more additional components therebetween).

Furthermore, reference throughout the specification to "one example", "another example", "an example", and so forth, means that a particular element (e.g., feature, structure, and/or characteristic) described in connection with the example is included in at least one example described herein, and may or may not be present in other examples. In addition, it is to be understood that the described elements for any example may be combined in any suitable manner in the various examples unless the context clearly dictates otherwise.

While several examples have been described in detail, it will be apparent to those skilled in the art that the disclosed examples may be modified. Therefore, the foregoing description is to be considered non-limiting.

What is claimed is:

1. A method of storing and using natural gas in a vehicle, comprising:

selecting a vehicle having a tank for storing natural gas for fueling an engine of the vehicle, the tank having a container body with a service pressure rating of about 3600 psi (pounds per square inch) and the tank having a natural gas adsorbent positioned in the tank;

transferring a first quantity of natural gas into the tank from a first source having a first source pressure of less than about 725 psi causing a first tank pressure to be up to 725 psi wherein the adsorbent adsorbs an adsorbed portion of the natural gas in the tank;

operating the engine after transferring the first quantity of natural gas without transferring additional natural gas into the tank until at least a portion of the natural gas has been desorbed from the adsorbent and consumed by the engine;

transferring a second quantity of the natural gas into the tank from a second source having a second source pressure of at least about 3600 psi to fill the tank to a second tank pressure of about 3600 psi wherein the adsorbent adsorbs an adsorbed quantity of the natural gas; and operating the engine after transferring the second quantity of the natural gas without transferring additional natural gas into the tank until at least a portion of the natural gas has been desorbed from the adsorbent and consumed by the engine.

2. The method as defined in claim 1 wherein the natural gas adsorbent has a Brunauer-Emmett-Teller (BET) surface area ranging from about 50 $m^2/g$ (square meters per gram) to about 5000 $m^2/g$ and pores with a pore size ranging from about 0.20 nm (nanometers) to about 50 nm.

3. The method as defined in claim 2 wherein the natural gas adsorbent is selected from the group consisting of a carbon, a porous polymer network, a metal-organic framework, a zeolite, and combinations thereof.

4. The method as defined in claim 2 wherein the natural gas adsorbent is inert to at least some components in the natural gas other than methane.

5. The method as defined in claim 1 wherein the natural gas adsorbent has a density ranging from about 0.1 g/cc to about 0.9 g/cc.

6. The method as defined in claim 1 wherein the container body is made of a high strength aluminum alloy or a high strength low-alloy (HSLA) steel.

7. The method as defined in claim 6 wherein the high strength aluminum alloy is chosen from a 6000 series aluminum alloy or a 7000 series aluminum alloy, and has a tensile yield strength ranging from about 275.8 MPa to about 503.3 MPa.

8. The method as defined in claim 6 wherein the container body has a weight ranging from about 5.9 kg (kilograms) to about 59 kg.

9. The method as defined in claim 6 wherein the container body has an inner diameter ranging from about 10.2 cm (centimeters) to about 40.6 cm.

10. The method as defined in claim 1 wherein the tank includes a guard bed positioned near an opening of the container body inside of the container body.

11. The method as defined in claim 1 wherein the tank includes a guard bed positioned near an opening of the container body outside of the container body.

* * * * *